United States Patent [19]

Blakley et al.

[11] Patent Number: 4,593,861

[45] Date of Patent: Jun. 10, 1986

[54] APPARATUS FOR PULPING PAPER MAKING STOCK AT HIGH CONSISTENCIES

[75] Inventors: Earl T. Blakley, Cincinnati; Paul G. Marsh, Hamilton, both of Ohio

[73] Assignee: The Black Clawson Company, Middletown, Ohio

[21] Appl. No.: 698,731

[22] Filed: Dec. 7, 1984

Related U.S. Application Data

[63] Continuation of Ser. No. 407,371, Aug. 12, 1982, abandoned.

[51] Int. Cl.[4] ..... B02C 13/18

[52] U.S. Cl. ..... 241/46.02; 241/46.17; 241/246; 241/257 R

[58] Field of Search ..... 241/21, 46 R, 46 B, 241/46.02, 46.17, 246, 257 R; 366/305, 307, 329; 68/134

[56] References Cited

U.S. PATENT DOCUMENTS

| | | | |
|---|---|---|---|
| 2,648,964 | 8/1953 | Graham | 68/174 |
| 2,659,226 | 11/1953 | Pellerin | 68/134 X |
| 4,048,820 | 9/1977 | Pielemeier | 68/134 X |
| 4,535,943 | 8/1985 | Conture | 241/46.17 X |
| 4,538,765 | 9/1985 | Mayr et al. | 241/46.17 X |

*Primary Examiner*—Howard N. Goldberg
*Assistant Examiner*—Timothy V. Eley
*Attorney, Agent, or Firm*—Beibel, French & Nauman

[57] ABSTRACT

Apparatus for pulping paper making stock at high consistencies, e.g. 10 percent to 25 percent solids, includes a cylindrical tub and a rotor constructed and arranged to apply primarily pumping force to the stock which causes it to travel outwardly to and upwardly along the tub wall. This climbing stock is continuously subdivided and directed back into the tub, and a feed screw extending vertically upward from the rotor assures continuous circulation which develops zones of intense hydraulic sheer constituting the major force for effecting the desired defibering.

10 Claims, 5 Drawing Figures

APPARATUS FOR PULPING PAPER MAKING STOCK AT HIGH CONSISTENCIES

This is a continuation of Ser. No. 407,371, filed Aug. 12, 1982, which is now abandoned.

This invention relates to apparatus and methods for pulping paper making stock at relatively high consistencies, namely with a solids content substantially in excess of 10 percent, e.g. 12 to 25 percent, as compared with conventional pulping consistencies which are commonly in the range of 4 to 6 percent solids.

BACKGROUND OF THE INVENTION

The concept and objectives of high consistency pulping of paper making stock are relatively old in the paper industry. See, for example, the paper entitled "High Consistency Pulping and Pumping" presented by an employee of the assignee of this application which appeared in *Paper Mill News* for June 21, 1947, and which reported laboratory experiments wherein paper stock was successfully pulped at 16.5 percent consistency. Successful commercial operation at such consistencies, however, has still remained elusive, as is relatively easy to understand when it is recognized that paper making stock at 15 percent consistency has such low fluidity that an average man can walk on the surface of a pool of it without sinking more than an inch or two.

The potential advantages of such an apparatus and method have also been well recognized. For example, since the cost of stock preparation is ultimately computed on the basis of units of oven dry fiber, pulping at high consistencies should be more efficient and less expensive, even if it might take longer for a given gallonage, in terms of both power and steam consumption for pulping at elevated temperatures.

The art has proposed a considerable variety of forms of apparatus for pulping at high consistencies, and one of the dominant theories has been that because of the resistance of such material to flow, successful high consistency pulping apparatus should operate with a kneading, grinding or tearing action. For example, designs have been proposed which appear to have been derived from such other apparatus as barking drums and hammer mills, and in another case from a cement mixer equipped with an internal rotor geared to operate in the opposite direction from the main drum.

SUMMARY OF THE INVENTION

The assignee of the present invention has been a pioneer in the development of pulpers for paper making stock characterized by comprising an upright cylindrical tub provided with a rotor of special construction mounted in the bottom thereof for rotation on a vertical axis coincident with the axis of the tub wall. One of the early designs of such pulpers of its manufacture is shown in the U.S. Pat. to Martindale No. 2,371,837 of 1945, and a more recent design in U.S. Pat. No. 3,073,535 to Vokes of 1963. The trademark "Hydrapulper" which it has used for this equipment since 1939 is so widely recognized that it has at times been in danger of conversion into a generic term for this type of apparatus.

The primary object of the present invention has been to develop and provide a pulper having the same basic design and operating characteristics as its predecessors in the line of "Hydrapulper" equipment but which would be specially adapted for effective and efficient pulping of paper making stock in a range of high consistencies, i.e. a range of approximatelv 10 to 25 percent solids. The successful accomplishment of this objective was found to depend upon a number of structural and operational features which appear not to have been recognized in the prior art of high consistency pulping.

For example, it was determined that the rotor should apply such radially outward force to the stock that the stock would not only travel to the wall of the tub but also climb the interior of this wall to a substantial extent, as it is quite capable of doing when of the high consistencies under consideration. It was also determined that accomplishment of this result required that the force applied to the stock should be firm but relatively gentle, i.e. a pushing force rather than a series of blows.

It was discovered that this combination of conditions required that each vane have a working face of substantial area, provided by the combination of substantial height as well as substantial extent circumferentially of the rotor body. This in turn required both that there be a relatively small number of vanes, and also that the curvature of the working faces of the vane be about a radius or radii of substantial length such that the radial distance from the trailing edge of the working face to the axis of the rotor is not very much greater than the radial space from the leading end of the working face to the rotor axis.

Thus where the rotor of the above Vokes patent has eight vanes provided with correspondingly short working faces whose leading ends are located relatively close to the rotor axis, optimum results have been obtained in the practice of the present invention with a rotor comprising only three vanes, so that the working face of each vane extends nearly 120° around the rotor body. Also, these working faces are relatively gently curved inwardly from the periphery of the rotor, to provide a sustained pushing action on the stock.

Another important discovery in the development of the invention was that the rotor should be substantially larger than in similar pulpers operating under standard conditions of relatively low consistency stock. For example, successful results have been consistently obtained in the past with a pulper comprising a cylindrical tub 8 ft. in diameter and a rotor of the construction shown in the above-noted Vokes patent which was 24 in. in diameter. In contrast, an 8 ft. pulper in accordance with the present invention for pulping high consistency stock will operate most effectively with a rotor 44 in. in diameter. This relationship also holds true for larger sized pulper tubs, the general rule being that the ratio of tub diameter to rotor diameter should be of the order of slightly more than 2:1, e.g. a 54 in. rotor in a tub 10 ft. in diameter.

As another comparison of the invention with prior practice, experiments using the rotor of the Vokes patent with high consistency stock established that it would soon reach what might be considered as an equilibrium condition wherein the rotor had created a clearance space in which it would simply spin without causing any further movement of the stock. In contrast, successful practice of the invention requires that the rotor impel the stock continuously outwardly with sufficient sustained force to cause it to reach and climb the inner surface of the cylindrical tub wall.

This condition, however, could also reach equilibrium, since the stock is sufficiently stiff to hold its position away from the rotor, and since also any stock which climbs the wall will tend to dewater by gravity drainage and thus become even stiffer. Accordingly, it was established in the development of the invention that provision must be made for continuously subdividing the wall of stock which is trying to climb the tub wall and diverting or redirecting that stock back toward the center of the tub. This was accomplished by the provision of baffles of novel design which cover substantial areas of the lower and midportion of the tub wall to effect the desired subdivision and redirection of the annular wall of stock which initially attempts to climb the wall of the tub, as well as to split this stock wall vertically and thus to facilitate folding it back into the tub.

In addition, it was discovered in the development of the invention that because stock of the high consistencies with which it deals is not sufficiently fluid to form a vortex such as develops in a pulper holding stock of lower consistency, special provision should be made to assure a continuous forced feed of stock to the central portion of the rotor and thence to the working faces of the rotor vanes, in order to maintain continuous circulation. This is accomplished in the practice of the invention by a feed screw mounted centrally of the rotor body and extending to a substantial height above the level of the vanes, optimum results having been obtained with this screw substantially equal in height to the diameter of the rotor.

While the provision of such feed screws is not broadly new, as shown, for example, by U.S. Pat. No. 3,305,781 to Wallen of 1962 the invention provides a feed screw which not only is substantially higher than suggested in the prior art, but it also has its lower end located in both vertically and radially spaced relation from the rotor vanes in a manner not suggested by the prior art and which is believed to contribute materially to the performance of the apparatus of the invention.

In summary, it appears that all of the individual novel features of the invention combined in effect to provide pulping apparatus and a pulping method for defibering high consistency paper making pulp stock wherein the primary force for carrying out the defibering is the frictional interaction of fiber clumps moving with respect to each other which causes them to rub each other apart in the presence of only enough water to cause them to break apart easily. This type of interaction between clumps or lumps of fiber is much more effective as a defibering force in high consistency stock than in stock of the lower consistencies which have been conventionally used for pulping, and it has been found under tests to accomplish effectively complete defibering in notably less time, on the basis of units of dry fiber, than conventional practice with low consistency stock.

These broadly described characteristics of the invention, which assist in distinguishing its structural and operational features from the prior art, will be more readily understood from the detailed description of preferred embodiments of the invention which follows.

DESCRIPTION OF THE PREFERRED EMBODIMENT

Figure 1:
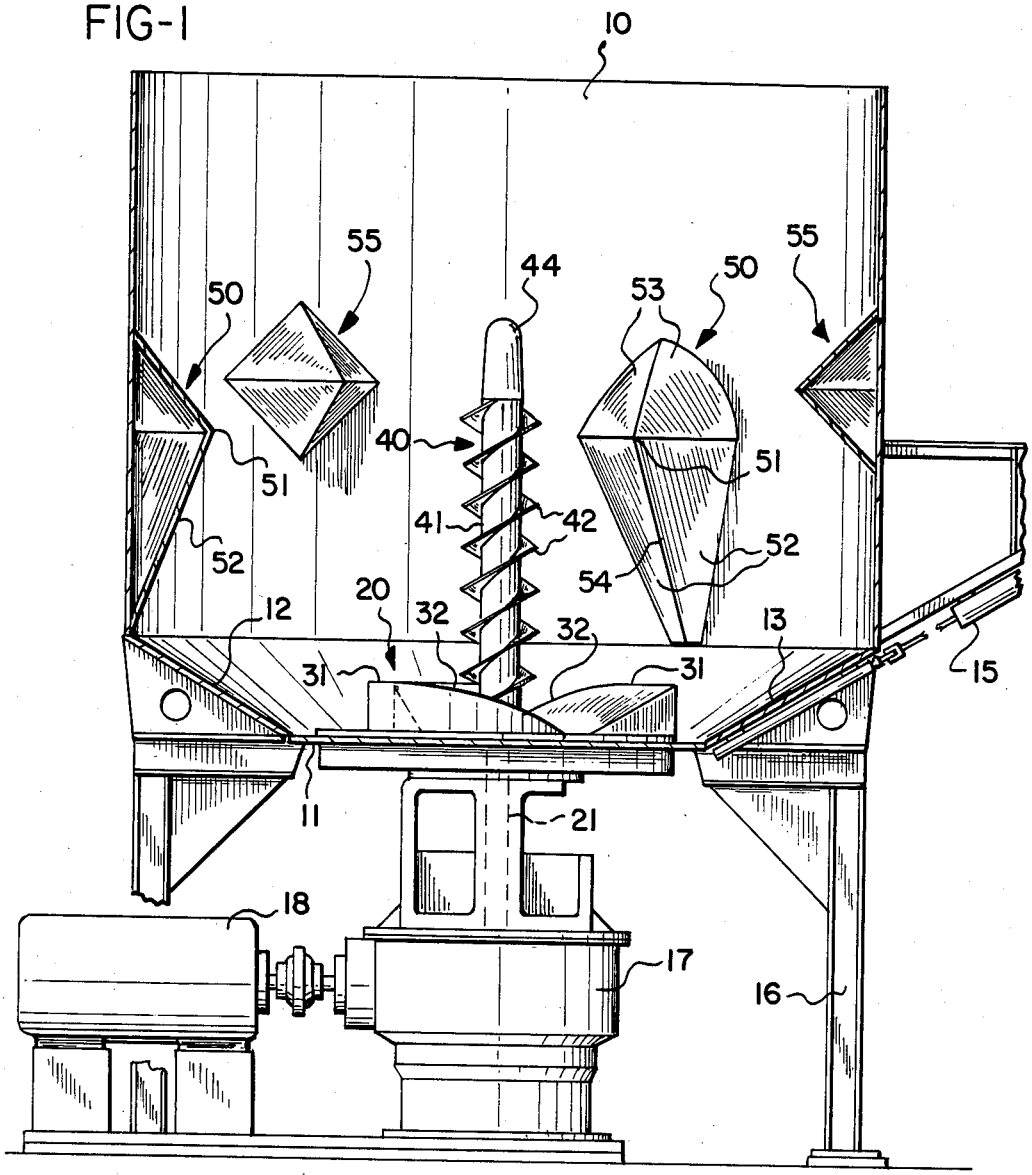
FIG. 1 is a view in vertical section, taken generally on the line 1—1 of FIG. 2, showing a high consistency pulper in accordance with the invention.
Figure 2:
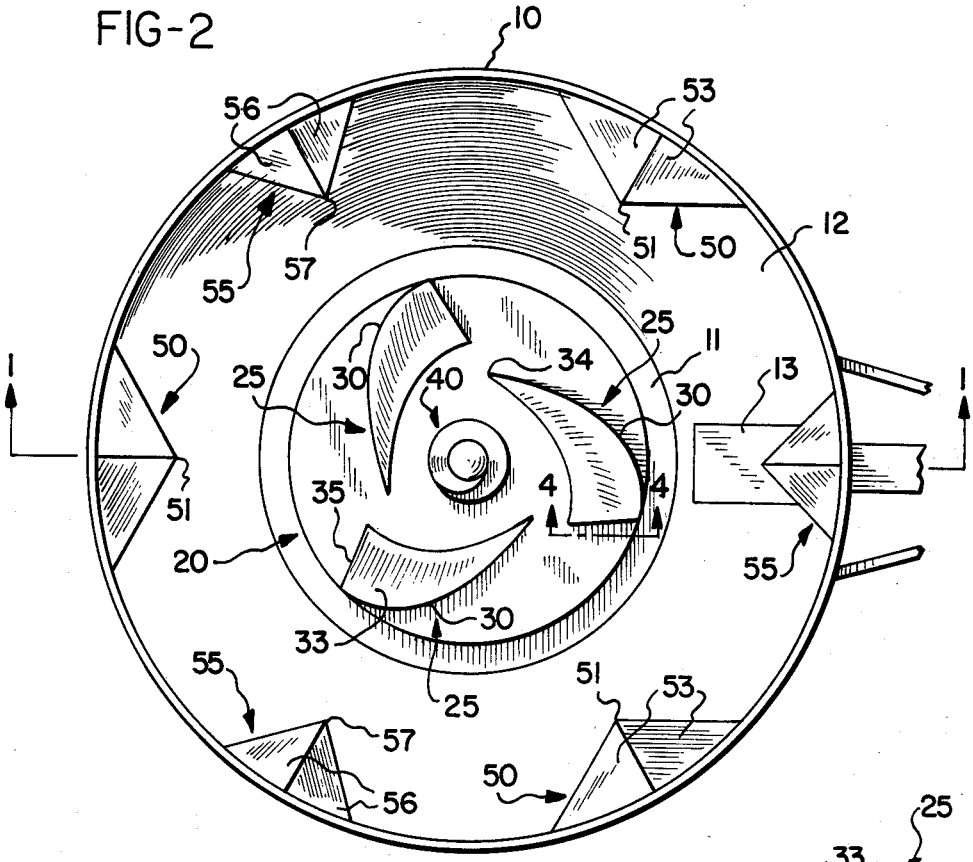
FIG. 2 is a plan view of the pulper of FIG. 1.

The pulper illustrated in FIGS. 1-2 includes a tub having a cylindrical upper wall 10, and a bottom wall comprising a plane center section 11 surrounded by an imperforate frusto-conical portion 12, which includes a dump valve 13 operated by a fluid pressure cylinder 15. The tub is mounted on supports 16 of any suitable character, and arranged below the tub is a gear drive 17 shown as directly driven by a motor 18.

Figure 3:
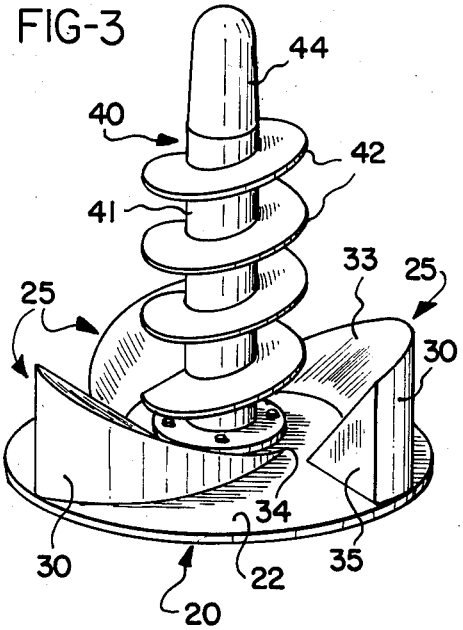
FIG. 3 is an isometric view of the rotor of FIGS. 1-2.
Figure 4:
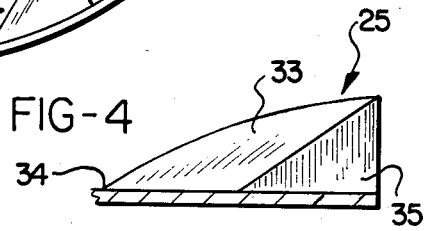
FIG. 4 is a fragmentary section on the line 5—5 of FIG. 3.

Among the major concerns of the present invention are the construction and operating characteristics of the rotor indicated generally at 20, which is mounted centrally of the bottom of the tub on a vertical shaft 21 driven by the gear drive 17. Referring particularly to FIGS. 2-4, the rotor 20 includes a circular plate 22 which forms the rotor body and is of a large diameter with relation to that of the tub, for example, a diameter of 44 inches where the diameter of the tub wall 10 is 8 feet.

The rotor 20 includes three vanes 25 on the upper surface of the rotor body 22 which are of special configuration illustrated in FIGS. 1-4. The working face 30 of each vane extends vertically from the surface of the rotor body 22, and as viewed from the side as shown in FIG. 1, the upper edge of each working face 30 comprises a straight portion 31 parallel with the bottom of the rotor body, and a portion 32 which is inclined downwardly from the portion 31 to a minimum height at the leading end of the vane, which is effectively zero at the point where the vane merges with the top of the rotor body 22.

The upper surface 33 of each vane 25 has a half-crescent shape as viewed in plan, and is inclined downwardly from its maximum height along the edge 31-32 to a minimum height of effectively zero at the leading end 34 of the vane where it also merges into the top of the rotor body 22. The angle defined by radii from the center of the rotor 25 to the opposite ends of each vane define an angle of substantially 120°, but the trailing end 35 of each vane is cut back, at an angle of approximately 40° to the radius to its radially inner end, and this surface 35 extends substantially vertically with respect to the rotor body 22.

As previously noted, the use of only three vanes on the rotor as shown correspondingly increases the effective length of the working face of each vane. In addition, with this working face relatively gently curved, and with its leading end spaced substantially outwardly from the axis of the rotor, the force applied to the stock by each vane is a relatively gentle pushing force with a substantial radially outwardly directed component, rather than a predominantly tangential component as with the rotor of the above-noted Vokes patent. The rotor of the invention therefore effects the defibering of high consistency pulp by inducing strong frictional interaction in the pulp rather than by mechanical or hydraulic action.

As a specific example of detailed dimensions wherein the rotor body 22 has a diameter of 33 inches, the maximum height of the working face 30 of each vane was 6 inches, and the straight section 31 of its upper edge was 5 inches in length. The maximum radial distance from the working face 30 to the center of the rotor was 16.5 inches, while the corresponding minimum distance was approximately 9 inches. In addition, the radial spacing from the leading end of each blade to the trailing end of the adjacent blade was 1.5 inches.

A feed screw indicated generally at 40 is mounted in the center of the rotor body 22 and comprises a cylindrical central body 41, flight means 42, and a rounded upper end cap 44 to prevent solid material from hanging up on top of the second body 41. Preferred results have been obtained on a 33-inch rotor with double flights 42 having a 6-inch pitch and an outer diameter of 8.75 inches on a central body 41 6.625 inches in diameter and substantially equal in height to the diameter of the rotor, and with the lower ends of the screw flights 42 spaced a substantial distance above the bottom of the rotor body 22, e.g. 6 inches. However, the invention is not limited to a feed screw having a specific number of flights, as illustrated by the single flight arrangement in FIG. 3.

It will also be noted that the outer radius of the screw flights 42 is substantially less than the minimum radial distance from the center of the rotor to the vanes 25, so that there is a substantial space between the screw flights and the rotor body as well as the upper surfaces of the vanes 25, as best seen in FIG. 2. It appears that this arrangement may contribute materially to the desired development of high frictional forces in the stock. More specifically, since the peripheral speed of the screw flights 42 is less than that of even the leading ends of the vanes 25, the stock delivered to the central portion of the rotor body at relatively low speed will be forced to accelerate suddenly when it is picked up by the leading ends of the vanes and thus literally torn away progressively from the remaining stock below the feed screw.

As previously noted, the effect of the rotor of the invention in pulping high consistency stock is to cause the stock to tend to travel up the cylindrical tub wall 10, an action which is aided by the frusto-conical bottom portion 12. Special provision is made in accordance with the invention to subdivide such climbing stock and direct it back toward the center of the tub where the feed screw 40 will force it down onto the surface of the rotor 20 for repeated action by the rotor vanes.

The primary such subdividing and directing means are three baffles 50, which are equispaced circumferentially of the tub wall, and which are of such generally pyramid shape and proportions that each baffle spans an angle of 60° of the cylindrical tub wall 10. Each baffle 50 has four sides which have a common dimension in a horizontal plane so that they define a point 51, but the two lower sides 52 are substantially longer than the two upper sides 53. More specifically, each of the lower sides 52 is generally trapezoidal except to the extent that its outer and lower edges are formed to match the curvature of the tub wall 10, with the smaller end located at approximately the level at which the frusto-conical bottom wall 12 meets the cylindrical wall 10.

In a pulper wherein the tub wall 10 is 8 feet in diameter and 90 inches high, preferred results have been obtained with each of the baffles 50 having an overall height of 56 inches, with the common dimension of its four sides being 24.375 inches, with the point 51 where its four sides meet being spaced inwardly 10.75 inches from the inner surface of the cylindrical wall 10, and with the point 51 located slightly above the highest level to which the tub is normally filled with stock e.g. 44 inches above the bottom of the cylindrical wall 10. In this example, the bottom end of each side 52 was 10 inches wide, but in a smaller pulper, this dimension may reduce to the point where each side 52 is triangular rather than trapezoidal.

With this construction and arrangement of each of the baffles 50, the lower and longer sides 52 are upwardly inclined inwardly of the tub with respect to the cylindrical wall 10, and they are also inclined in opposite directions inwardly with respect to the wall 10 in a horizontal plane so that regardless of the direction of rotation of the rotor 20, one of these sides will be positioned to intercept stock travelling around the wall 10 in the direction of rotation of the rotor. Thus with the rotor 20 constructed to rotate counterclockwise as viewed in FIG. 2, stock tending to travel around the wall 10 under the impelling force of the rotor will encounter the clockwise-facing portion 52 of each of the baffles 50, which will tend to redirect that stock both toward the center of the tub and also downwardly, with this redirecting force increasing as the stock climbs higher.

The major component of movement of the stock along the tub wall is vertical, rather than circumferential, as a climbing wall of relatively self-supporting pulp, and the peak 54 along which the baffle surfaces 52 are joined, and especially the point 51 where they join the portions 53, tend to cut or otherwise to subdivide the climbing wall of pulp into strips which are more easily redirected back into the tub. Under usual operating conditions, all such climbing stock will be redirected back into the tub before it reaches the upper sides 52 of any of the baffles 50, but if any stock should climb that high, it will tend to slide by gravity back into the tub along the smooth surfaces of the baffle sides 53, which are inclined downwardly at angles in the range of 40° to 50°.

Satisfactory results have been obtained in testing the invention with a pulper equipped with only three of the baffles 50, which will effectively cover one-half of the cylindrical wall 10, but it has also been found desirable to provide an additional baffle 55 in each of the spaces between adjacent baffles 50. Each of the baffles 55 has four generally triangular sides 56 of the same dimensions to provide a generally diamond shape with a point 57.

These diamond-shaped baffles 55 supplement the action of the baffles 50 in subdividing any pulp which climbs that high along the wall 10 between the baffles 50, and redirecting the resulting strips back into the tub. In an 8-foot pulper provided with baffles 50 of the dimensions noted above, good results were obtained with baffles 55 17.625 inches along each edge which projected 10.75 inches into the tub with their points 57 approximately 6 inches higher than the points 51 of the baffles 50.

High consistency pulping is by necessity a batch operation, since the stock is too dry for continuous pulping such as is commonly done with stock in the range of 6 percent consistency or less. Therefore, with the pulper shown in FIGS. 1 and 2, when a given batch has been sufficiently defibered, the dump valve 13 is opened, and discharge of the contents of the tub is effected therethrough with the aid of added water while the rotor is operating. It is also practical, however, to provide the tub with a perforated extraction plate below the rotor, namely with the plane bottom wall 11 in FIG. 1 perforated and communicating with a collection chamber therebelow from which stock is piped away, as shown in the above Vokes patent.

Figure 5:
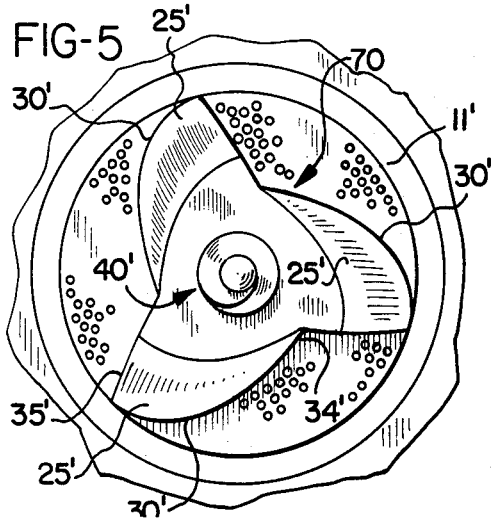
FIG. 5 is a plan view showing another form of rotor in accordance with the invention in combination with a perforated extraction bed plate.

FIG. 5 shows a rotor in accordance with the invention particularly designed for use with such a perforated bed plate. This rotor 70 is in most respects identical with the rotor shown in FIGS. 1–4, and the parts thereof have accordingly been similarly designated with reference characters 25', 30' and so forth. The primary distinction between the two rotors is that where the rotor body 22 in FIGS. 3–6 is circular, and thereby provides web portions in the spaces between the trailing and leading faces of the vanes 25, there are no such web portions in the rotor 70 so that when this rotor is used in a tub provided with a perforated bed plate 11', the surface portions of the bed plate between the vanes of the rotor will be exposed, as shown in FIG. 5.

The primary advantage of a pulper of the invention provided with a perforated bed plate and the rotor of FIG. 5 is that after completion of a batch pulping operation, the stock is extracted through the bed plate by adding dilution water at the center of the tub while the rotor is in operation, and the bed plate acts as a strainer to retain contaminant materials too large to pass through the holes in the bed plate. Otherwise, the operation of a pulper of the invention provided with a rotor and bed plate as shown in FIG. 5 is essentially the same as already described in connection with FIGS. 1–4.

Testing results carried out with pulpers of the invention as shown and described herein have established that they are not only highly effective in their defibering action on high consistency pulp, but also highly efficient. Thus while it would logically be thought that adequate defibering of a given volume of stock at a high consistency such as 20 percent would take a longer time than for the same volume at 8 percent, the contrary has found to be the case in some test results.

As a specific example of such unexpected results, it has been established that complete defibering of a 300 gallon batch of deink stock, containing 200 pounds of air-dry fiber and therefore having a consistency of 8 percent, requires 15–20 minutes in a five foot pulper equipped with a standard rotor in accordance with the Vokes patent. In contrast, a 300 gallon batch of deink stock containing 500 pounds of air-dry fiber and therefore having a consistency of 20 percent, will be completely defibered in a five foot pulper of the present invention in only 10 minutes. While this may be an exceptional case, due to the ready defiberability of the deink stock, tests with a variety of stocks have established that as a generaly rule, complete defibering in a pulper in accordance with the present invention at consistencies as high as 25 percent require approximately the same time period as the same volume of stock at conventional consistencies of 6–8 percent.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. Pulping apparatus for defibering paper making stock at high consistencies, comprising:

(a) a tub having an upwardly extending cylindrical wall and open at the top thereof to receive stock to be defibered, (b) a rotor mounted for rotation on a vertical axis in the center of the bottom of said tub, (c) drive means constructed to rotate said rotor only in a single predetermined direction, (d) said rotor including vanes each having a single working surface facing in said direction of rotation for responding to rotation of said rotor by impelling high consistency pulp stock within said tub toward said tub wall with sufficient force to climb said wall, (e) baffle means on said wall positioned to redirect said climbing stock back toward the center of said tub, (f) feed screw means mounted on said rotor for rotation therewith in said direction and including flight means responsive to said rotation to force stock downwardly for impact by said vanes, and (g) valve means in the bottom of said tub for dumping the contents of said tub.

2. Pulping apparatus as defined in claim 1 wherein said baffle means comprise a plurality of baffle members arranged in angularly spaced relation on said wall and each including a surface extending upwardly from a level adjacent the bottom of said wall in upwardly inclined relation with said wall inwardly of said tub and means for subdividing stock climbing said wall.

3. Pulping apparatus as defined in claim 1 wherein said baffle means comprise a plurality of baffle members arranged in angularly spaced relation on said wall and each including a pair of contiguous surfaces extending upwardly from a level adjacent the bottom of said wall in upwardly inclined relation with said wall inwardly of said tub, said surfaces also being inclined in opposite directions with respect to said tub wall as viewed in plan to form a vertically extending edge terminating in a point at the upper end thereof for subdividing stock climbing said wall.

4. Pulping apparatus as defined in claim 3 wherein the dimensions of said surfaces in horizontal planes are at a minimum at the bottom thereof and at a maximum at the top thereof.

5. Pulping apparatus as defined in claim 3 wherein said baffle means also comprise a plurality of diamond-shaped baffle elements arranged in alternating relation with said baffle members and each including a pair of essentially triangular contiguous surfaces facing generally downwardly toward the interior of said tub.

6. Pulping apparatus as defined in claim 4 wherein each said baffle member is generally pyramid-shaped and includes an upper pair of generally triangular surfaces each having a vertically extending edge in common with the other and a horizontally extending lower edge in common with the upper edge of one of said first named pair of surfaces.

7. Pulping apparatus as defined in claim 1 wherein the ratio of the diameter of said tub to the diameter of said rotor is in the range of 2.2:1 to 2:1.

8. Pulping apparatus as defined in claim 7 wherein the height of said feed screw means is substantially equal to the diameter of said rotor.

9. Pulping apparatus as defined in claim 1 wherein (a) said rotor includes a rotor body mounted on a drive shaft extending vertically upwardly from said drive means, (b) said vanes extend generally circumferentially on said rotor body, (c) each of said vanes has a substantially vertical working outer face which is inclined from a maximum height at the trailing end thereof to a minimum height at the leading end thereof, and (d) each of said vanes has an upper surface which is inclined from the top of said working face thereof to said minimum height along the entire radially inner edge thereof.

10. Pulping apparatus as defined in claim 9 wherein (a) there is a total of three of said vanes, (b) radii from the axis of said rotor to the leading and trailing ends of each of said vanes define an angle of substantially 120°, (c) said working faces of said vanes are curved about relatively large radii, and (d) the leading end of each of said vanes is spaced a substantial distance radially from the axis of said rotor, (e) whereby said vanes exert relatively steady but gentle outwardly impelling force on stock within said tub.

* * * * *